United States Patent [19]

Rankin

[11] Patent Number: 4,699,216

[45] Date of Patent: Oct. 13, 1987

[54] BLOWOUT PREVENTER FOR A SIDE ENTRY SUB

[76] Inventor: E. Edward Rankin, 3550 Wind River Ct., Ridglea Country Club Estates, Fort Worth, Tex. 76116

[21] Appl. No.: 895,697

[22] Filed: Aug. 12, 1986

[51] Int. Cl.[4] ..... E21B 23/06; E21B 33/128; E21B 33/129; E21B 47/00

[52] U.S. Cl. ..... 166/385; 166/65.1; 166/120; 166/129; 166/386; 166/387

[58] Field of Search ..... 166/250, 113, 65.1, 166/117.5, 120, 129, 385, 387, 386; 175/230, 104, 98, 99, 243, 325, 40

[56] References Cited

U.S. PATENT DOCUMENTS

| | | | |
|---|---|---|---|
| 3,606,924 | 9/1971 | Malone | 175/230 X |
| 4,071,084 | 1/1978 | Brown et al. | 166/387 X |
| 4,200,297 | 4/1980 | Tricon | 166/242 X |
| 4,388,969 | 6/1983 | Marshall et al. | 166/242 |
| 4,399,877 | 8/1983 | Jackson et al. | 166/65.1 X |
| 4,457,370 | 7/1984 | Wittrisch | 166/65.1 X |
| 4,524,834 | 6/1985 | Barron et al. | 166/385 |
| 4,597,440 | 7/1986 | Pottier | 166/250 |

*Primary Examiner*—Stephen J. Novosad
*Attorney, Agent, or Firm*—James E. Bradley

[57] ABSTRACT

A side entry sub logging system has features for preventing a blowout should a kick in the casing annulus occur. A packer is mounted to the side entry sub below the sidewall passage. The packer has an elastomeric element for expansion of the element into sealing engagement with the casing. An actuating assembly is mounted in the sub for actuating the packer into sealing engagement with the casing. The actuating assembly acts to set slips in response to hydraulic pressure applied to the interior of the drill pipe from the surface. Then the drill pipe is picked up to move the elastomeric element into compression against the casing. The packer is released by removing the hydraulic pressure and lowering the drill pipe.

12 Claims, 20 Drawing Figures

BLOWOUT PREVENTER FOR A SIDE ENTRY SUB

BACKGROUND OF THE INVENTION

1. Field of the Invention

This invention relates in general to well logging with a side entry sub, and in particular to a blowout preventer for sealing the sub in casing should a kick occur.

2. Description of the Prior Art

Most oil wells are logged at least once during drilling. In conventional logging, the drill pipe will be pulled, and one or more instruments are lowered on a conductor cable into the open hole to measure earth formation characteristics.

Deviated wells which may incline up to 65 degrees or more are common, particularly at offshore locations. A number of wells may be drilled from a single platform. These wells present difficult problems for logging. The logging instruments may not be able to reach bottom due to the inclination. Also, the cable dragging against the curved portion of the well may create a slot or key seat, causing the instrument to become stuck.

A recent technique has been developed to log deviated wells. In this technique, when it is desired to log a portion of the well, the drill pipe is pulled. The logging instruments are located in special housings and secured to the lower end of the drill pipe. The drill pipe is lowered into the well until it is located near the upper end of the zone to be logged.

Then, a side entry sub is secured to the upper end of the drill pipe. A side entry sub has a passage extending through its side wall for cable to pass. A latch is threaded through the side wall passage, and a packing is placed around the side wall passage. The latch is pumped down with drilling fluid pressure into electrical engagement with the instruments at the bottom of the well. The cable is laced under tension, and a clamp secures the cable to the side entry sub.

The string is then lowered farther into the well. Normally, tie wraps will be used to secure the cable to the exterior of the drill pipe as the string is lowered into the well. When the bottom of the well is reached, the side entry sub may be several thousand feet below the surface, but it will still be located in casing.

To log the well, the drill string is then pulled upward. The instruments are energized while each stand is pulled to log the well. Cable at the surface is simultaneously taken up. When the side entry sub again reaches the surface, the clamp is removed, and tension is applied to the cable to casue the latch to release from its connection to the logging instruments. The cable is then pulled from the drill pipe and the drill string is then removed normally.

Serious problems result if a kick occurs while the side entry sub is located in the well. "Kick" refers to pressure in the well forcing the drilling mud surrounding the pipe upwardly. A kick may occur when the hydrostatic pressure of the drilling mud is less than the formation pressure. If the kick is not controlled, the formation pressure will continue to blow the drilling mud from the hole, possibly resulting in an uncontrolled blowout and a fire. A blowout is a disaster, resulting normally in the loss of the well, the drilling rig, and huge sums spent in controlling the blowout.

During normal drilling, if such a kick occurs, blowout preventers located at the surface are actuated to close the annulus around the drill pipe. A blowout preventer has a large rubber element that is pushed inwardly to seal tightly around the drill pipe. Then, heavy mud is pumped down to overcome the pressure in the well.

If a kick occurs during side entry sub logging, however, the conventional blowout preventer will not seal around the drill pipe because the logging cable will be located on the exterior of the drill pipe. Pressure will leak through the contact point of the blowout preventer with the cable, causing erosion and leakage to continue. About all that can be done should a kick occur during side entry sub logging is to pull the string upward, cut the cable at a point as low as possible, then lower the string back into the well and close the blowout preventer. While this procedure allows the well to be controlled, it results in loss of the cable. Logging cable is expensive. Also, it will likely be difficult to pull the cable from the drill string subsequently.

SUMMARY OF THE INVENTION

A blowout preventer is provided that will seal the side entry sub in the casing at a point below where it enters the opening in the side entry sub. The blowout preventer preferably includes a check valve which is dropped into the drill string and lowered into the sub should a kick occur. The check valve seals in the bore of the sub above the side opening, and allows fluid to be pumped down, but not up.

Drilling fluid pressure applied from the surface to the interior of the drill pipe acts on a packer which includes an elastomeric element. The drilling fluid pressure expands slips or dogs out into engagement with the casing. The drill string is then picked up a short distance to compress the elastomeric element of the packer into the casing wall. Once the well is under control, the packer can be released by lowering the string.

DESCRIPTION OF THE PREFERRED EMBODIMENT

Figure 1:
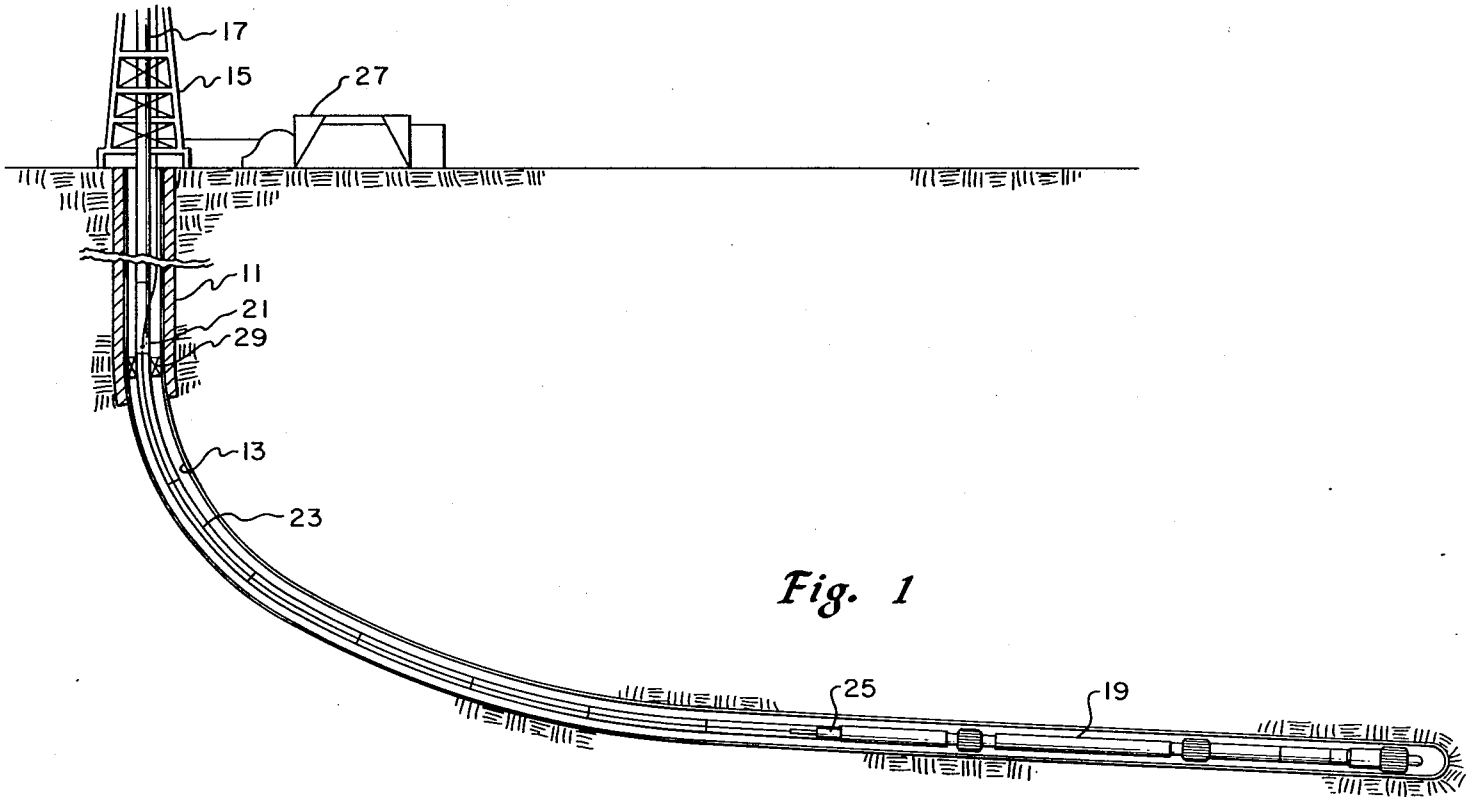
FIG. 1 is a schematic side view illustrating a side entry sub logging system.

Referring to FIG. 1, a well is shown in the process of being logged with a side entry sub logging system. The well has casing 11 which extends into the well to a selected depth, which could be several thousand feet. Open hole 13 extends below the casing 11. A drilling rig 15 is located above the well for lowering and raising the string of drill pipe 17.

In the side entry sub logging system, logging instruments 19 located within housings are secured to the lower end of the drill pipe 17. These logging instruments may be of various types, and would normally include a tool using radioactivity for measuring the density of the earth formations, and an induction electrical tool for measuring resistivity of the earth formations. The instruments 19 are connected through a conventional latch 25 to cable 23 which extends to the surface. The cable 23 is conductor cable, having at least one insulated conductor for providing power and passing signals between the instruments 19 and a logging unit 27 at the surface.

The cable 23 passes through a passage in the sidewall of a side entry sub 21. The cable 23 above the side entry sub 21 passes along the exterior of the drill pipe 17 to the surface. The cable passes over sheaves (not shown) in the drilling rig 15 and is wrapped around a winch which is a part of the logging unit 27.

A packer or blowout preventer 29 is shown schematically in FIG. 1. Packer 29 is a part of the assembly of the side entry sub 21, and is located immediately below the point at which the logging cable 23 enters the side entry sub 21. The packer 29 is adapted to be selectively set in the casing 11 to seal the annulus around the drill string 17 should a kick occur.

The assembly of the side entry sub 21 also has incorporated within it a release system to enable the side entry sub 21 to be released from the drill pipe and pulled upwardly should the drill pipe 17 become stuck while logging. The release system is shown and described in more detail in application Ser. No. 837,383, filed Mar. 7, 1986, E. Edward Rankin, Side Entry Sub Well Logging Apparatus and Method.

Blowout Preventer

Figure 2A:
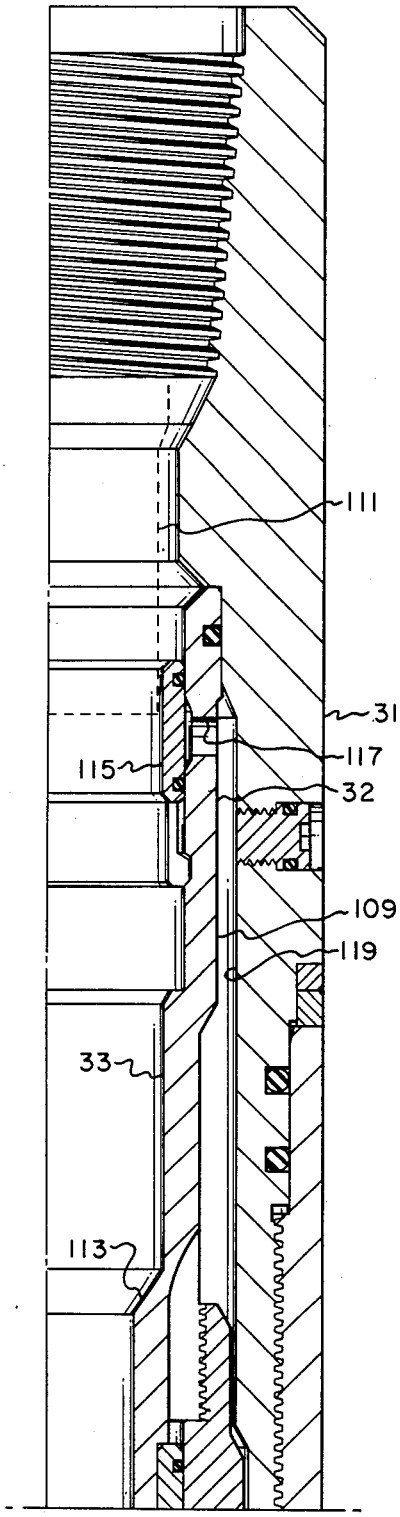
FIGS. 2*a*–2*i* are sectional views of a side entry sub assembly having a blowout preventer constructed in accordance with this invention.
Figure 2B:
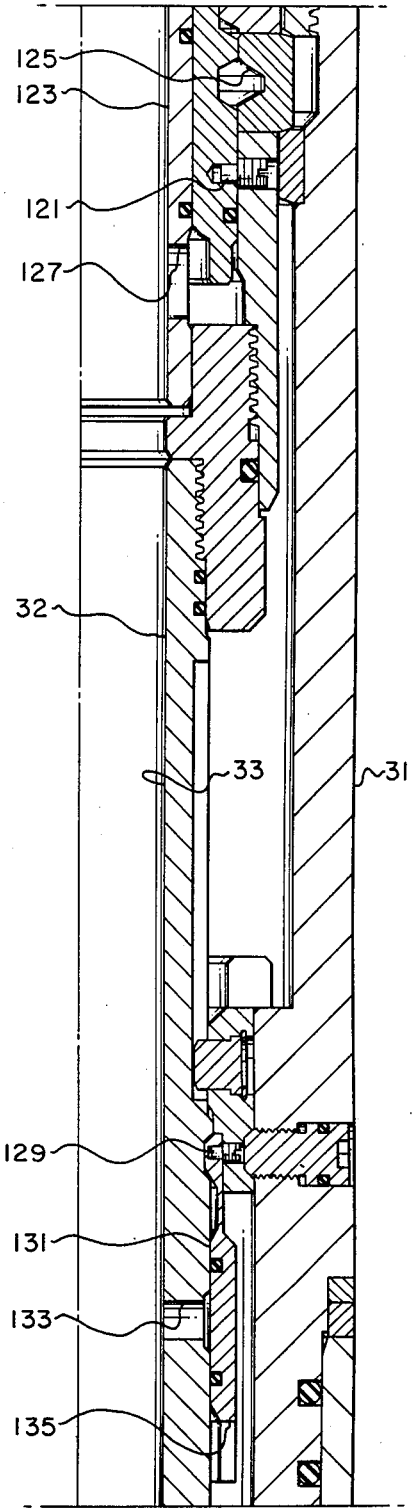
Figure 2C:
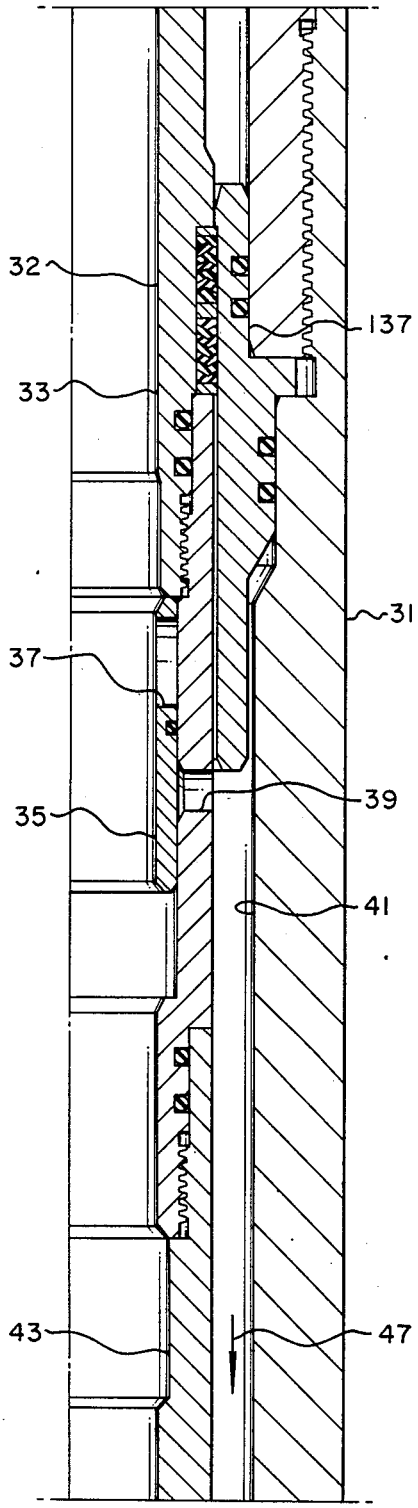
Figure 2D:
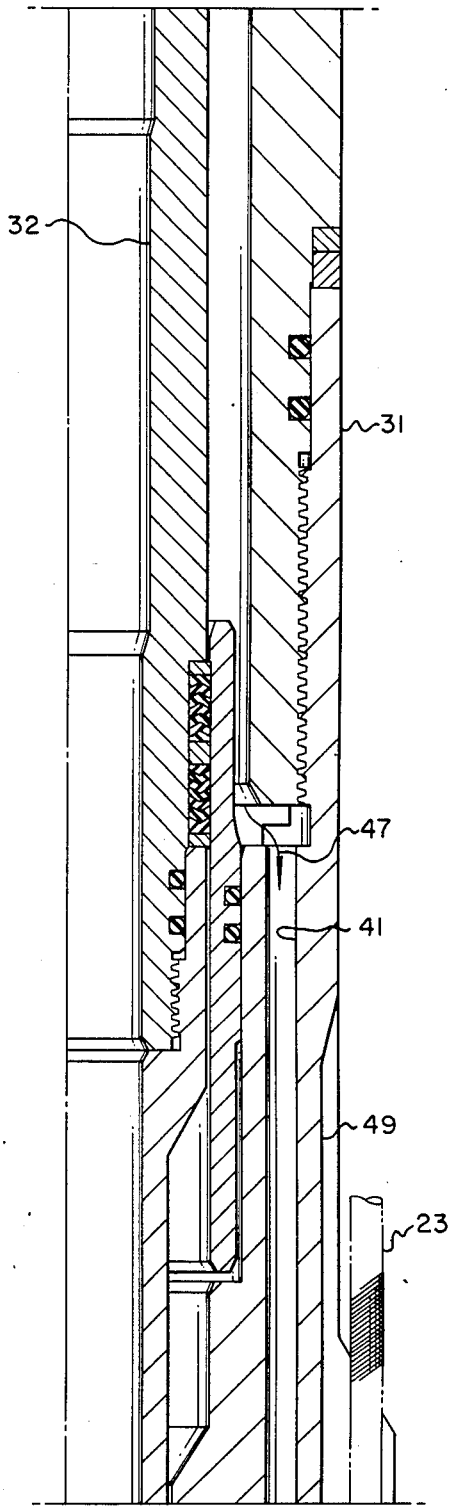
Figure 3A:
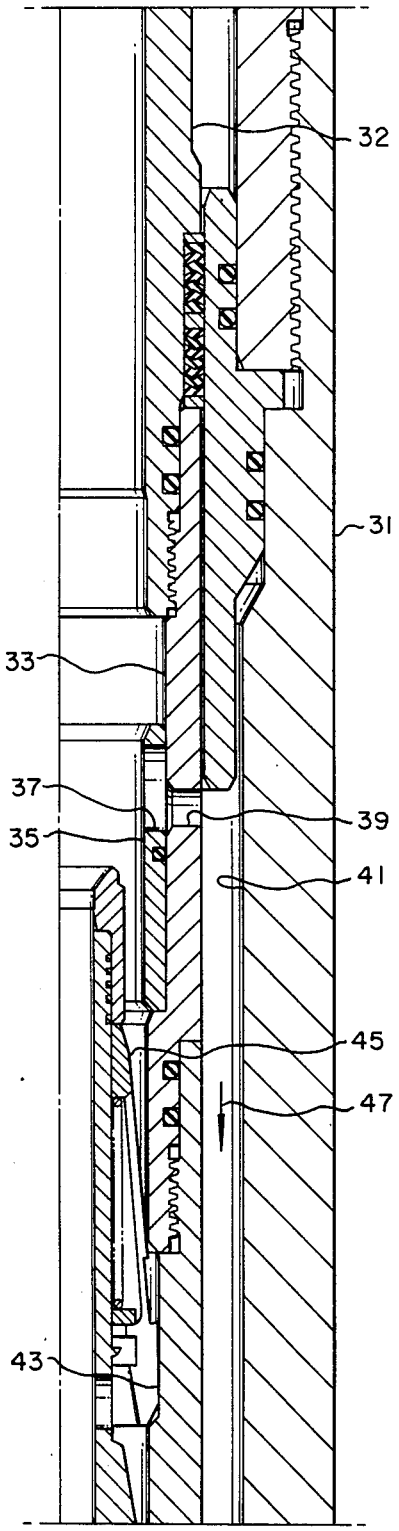
FIGS. 3*a* and 3*b* are sectional views of portions of the side entry sub assembly of FIG. 2, showing the blowout preventer in the process of being actuated.

Referring to FIG. 2*c*, the downhole apparatus which forms a part of the side entry sub 21 assembly includes an outer housing 31. A mandrel 32 is reciprocally carried in the outer housing 31 for releasing the side entry sub 21 from the drill pipe 17, as will be described subsequently. Mandrel 32 has a bore 33 therein. A piston valve 35 is reciprocally carried in the bore 33. Piston valve 35 is a sleeve member having a port 37 that is shown in the closed position in FIG. 2*c*. When piston valve 35 is moved to the lower position as shown in FIG. 3*a*, the port 37 will align with a piston port 39.

Port 39 is in fluid communication with a piston fluid passage 41 that extends downwardly between the outer housing 31 and the mandrel 32. The mandrel bore 33 has a seat 43 located in it a short distance below the piston valve 35. Seat 43 is adapted to sealingly receive a check valve 45, shown in FIG. 3*a*. Check valve 45 is a tubular member that is dropped into the drill pipe 17 at the surface should a kick occur. Check valve 45 has an axial bore, with a ball 46 and spring 48 check valve contained therein to allow downward flow through the check valve 45, but to prevent upward flow. Check valve 45 is a commercially available element, purchased normally to be dropped into a drill string during conventional drilling should a kick from the interior of the drill pipe occur. One such check valve 45 is manufactured by Hydril Mechanical Products Division and it is known as a wireline retrievable drop-in check valve.

As check valve 45 passes through the bore 33 to the seat 43, it will engage the piston valve 35 and pull it to the lower position aligning the ports 37 and 39. Drilling fluid pumped from the surface into the drill pipe 17 may then flow into the piston fluid passage 41 as shown by the arrows 47 in FIGS. 2*c*, 2*d*, 2*e*, 2*f* and 2*g*.

Figure 2E:
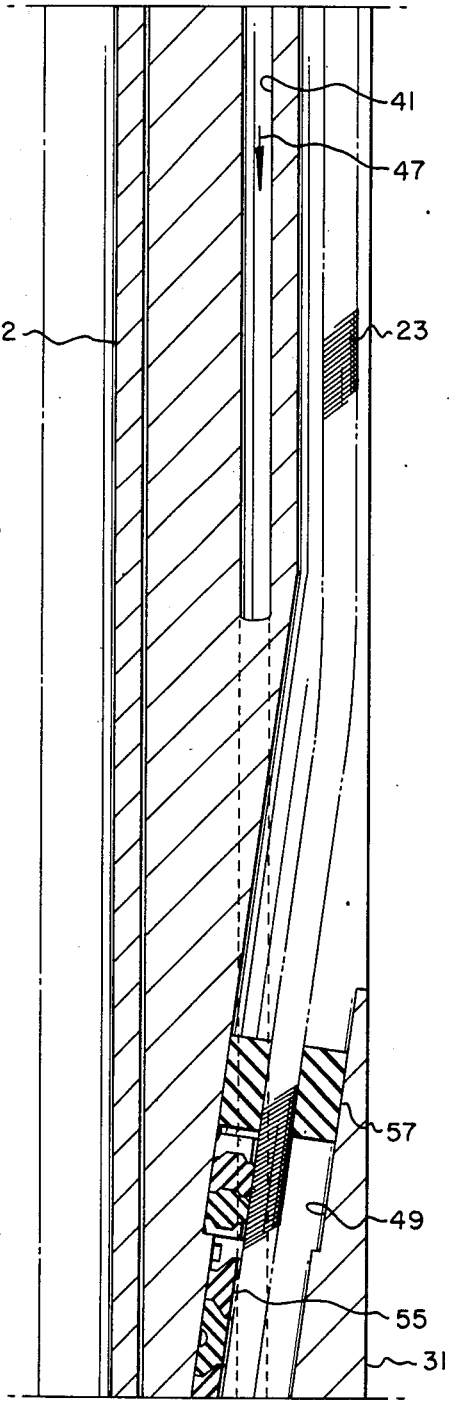
Figure 2F:
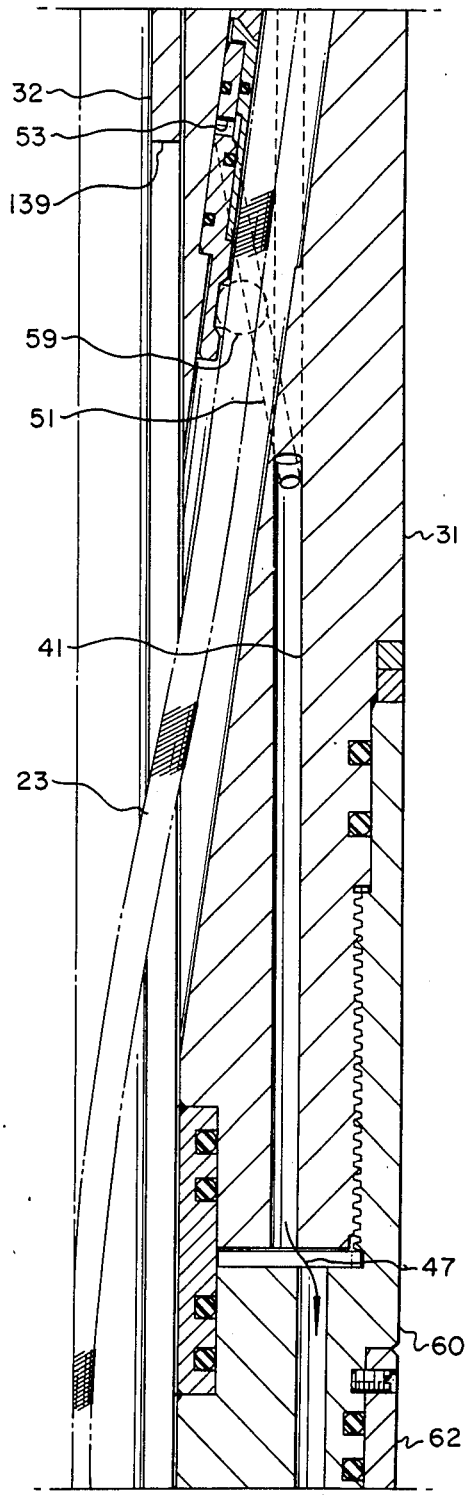

Referring to FIG. 2*e*, the logging cable 23 passes through a side opening 49 in the sidewall of the outer housing 31. As shown in FIG. 2*f*, a portion of the drilling fluid pressure applied in the passage 41 passes into a packoff passage 51. The packoff passage 51 leads to a packoff piston 53. Piston 53, when pressurized, applies pressure to seals 55 to seal tightly around the cable 23. Packoff seals 57 (FIG. 2*e*) are also conventionally installed for sealing around the cable 23. A spring biased ball 59 (FIG. 2*f*) is positioned to locate against the seals 55 to seal the side opening passage 49 should the cable 23 be broken or removed.

Referring still to FIG. 2*f*, the outer housing 31 is secured on its lower end to an inner barrel 60. An outer barrel 62 is secured to the outer side of the inner barrel 60, as shown also in FIG. 2*g*. An annular clearance exists between the inner and outer barrels 60 and 62. A piston 61 is located in this annular clearance. Piston 61 has an upper portion 61*a* and a lower portion 61*b*. The cross-sectional pressure area of the upper portion 61*a* is smaller than the cross-sectional pressure area of the lower portion 61*b*. As a result, if the same hydraulic fluid pressure is applied to the top of the upper portion 61*a* and the bottom of the lower portion 61*b*, the net force will be upward, causing the piston 61 to move upward. A lower extension 61*c* is mounted to the lower portion 61*b*.

Figure 2G:
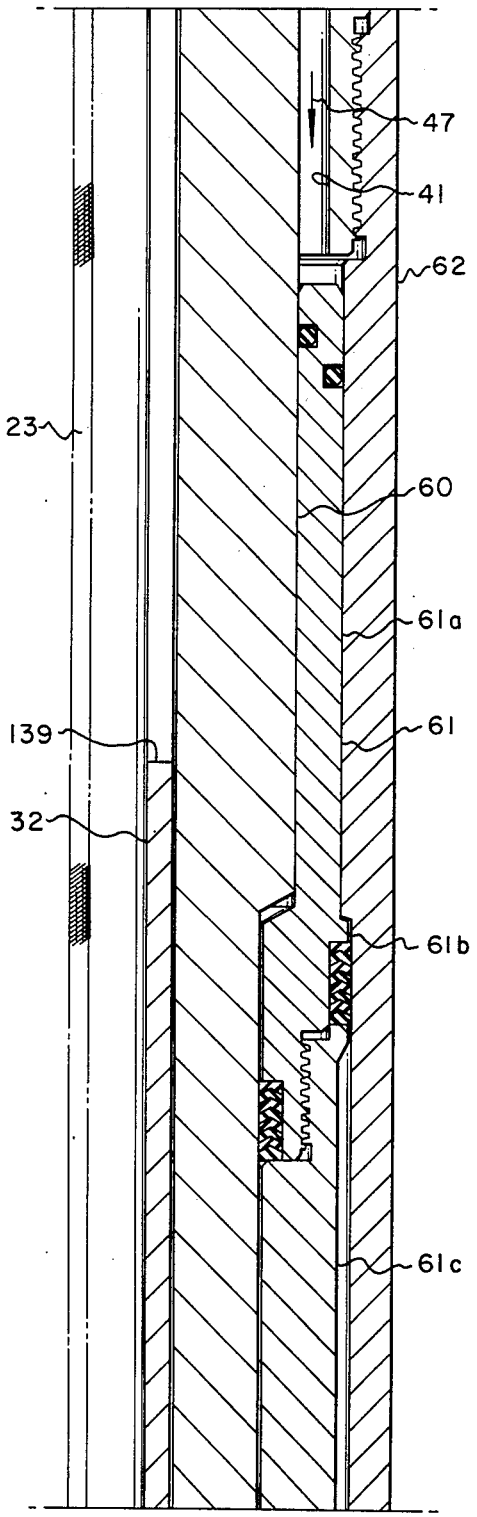
Figure 2H:
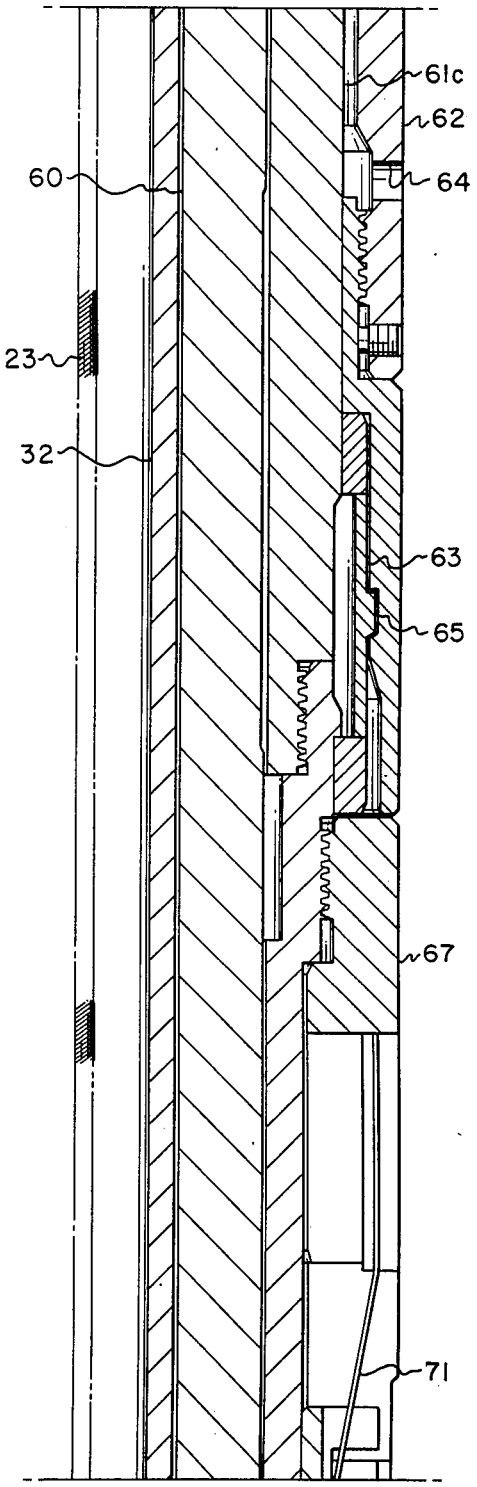

Referring to FIG. 2*h*, a release port 64 extends through the sidewall of the outer barrel 62. The release port 64 communicates hydrostatic fluid pressure in the annulus surrounding the drill pipe 17 with the lower side of the piston lower portion 61*b*.

Figure 4A:
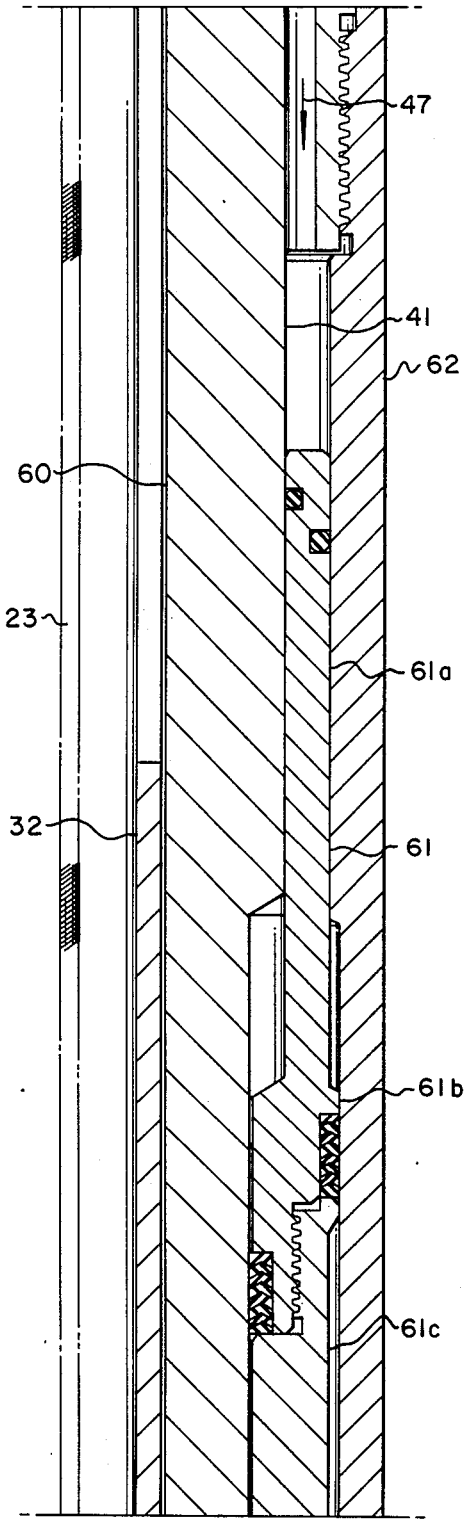
FIGS. 4*a*–4*c* are sectional views of other portions of the assembly of FIG. 2, showing the blowout preventer in the process of being actuated.
Figure 4B:
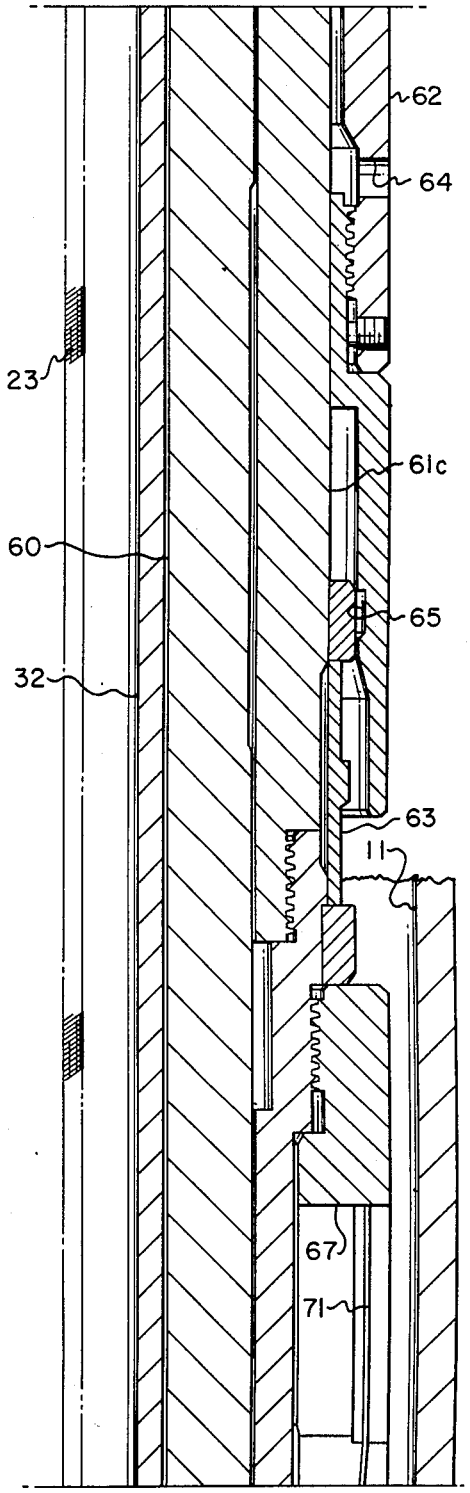

As shown in FIG. 2*h*, the piston lower extension 61*c* has mounted to it for movement therewith a collet 63. Collet 63 engages a groove 65 formed in the outer barrel 62. The collet 63 holds the piston lower extension 61*c* in the upper position shown in FIG. 2*h*, unless sufficient downward force is applied to cause the collet 63 to disengage from the groom 65 as shown in FIG. 4*b*. FIG. 4*a* shows the piston 61 in the lower position.

Figure 2I:
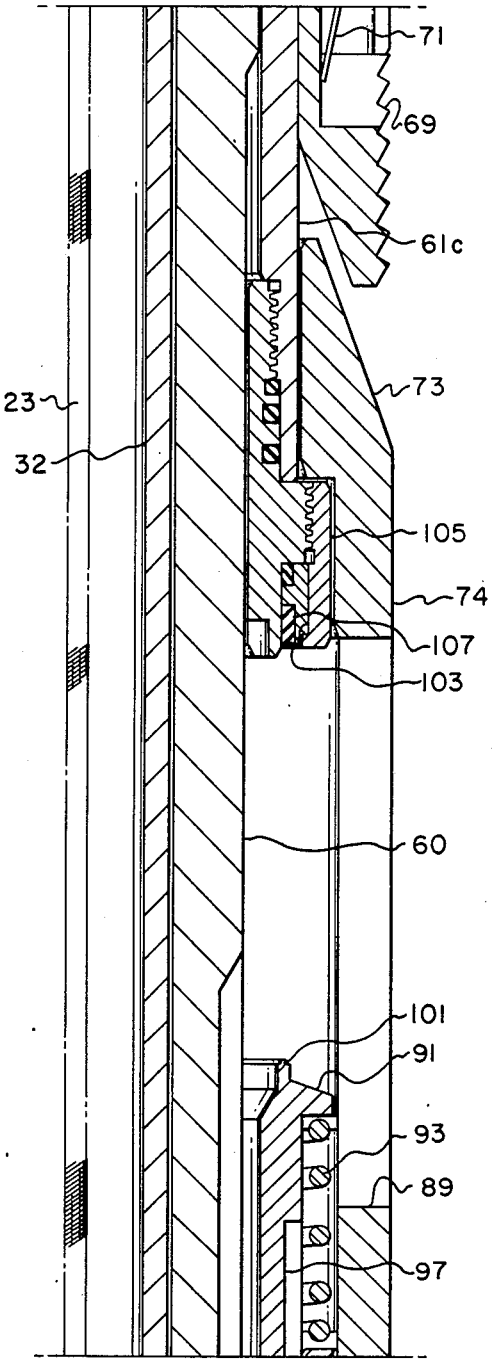

Referring still to FIG. 2*h*, a slip retainer 67 is mounted to the piston lower extension 61*c* for movement therewith. Slip retainer 67, as shown in FIG. 2*i*, carries a plurality of slips or dogs 69. The dogs 69 have serrated gripping surfaces on the exterior and are retained with the slip retainer 67 by flat springs 71. In the retracted position, shown in FIG. 2*i*, the dogs 69 protrude no greater than the outer diameter of the slip retainer 67.

Figure 4C:
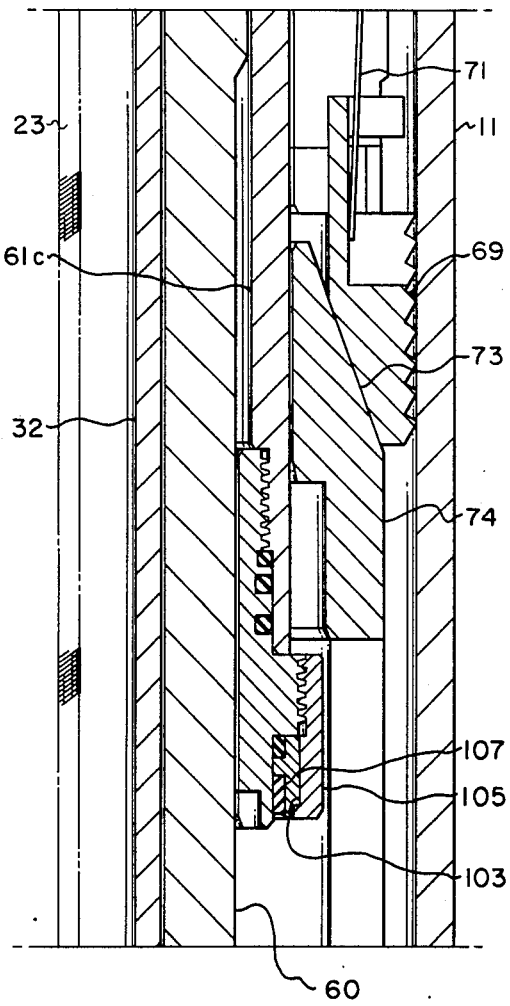

A cone body 74 having a cone surface 73 is mounted directly below the dogs 69. The wedge-shaped cone surface 73 causes the dogs 69 to expand outwardly when the slip retainer 67 is moved downwardly relative to the cone body 74. The extended position with the dogs 69 engaging the casing 11 is shown in FIG. 4*c*. The slip retainer 67 (FIG. 2*h*) moves the dogs 69 (FIG. 2*i*) downwardly as a result of the downward movement of the piston 61 (FIG. 2*g*).

Figure 2J:
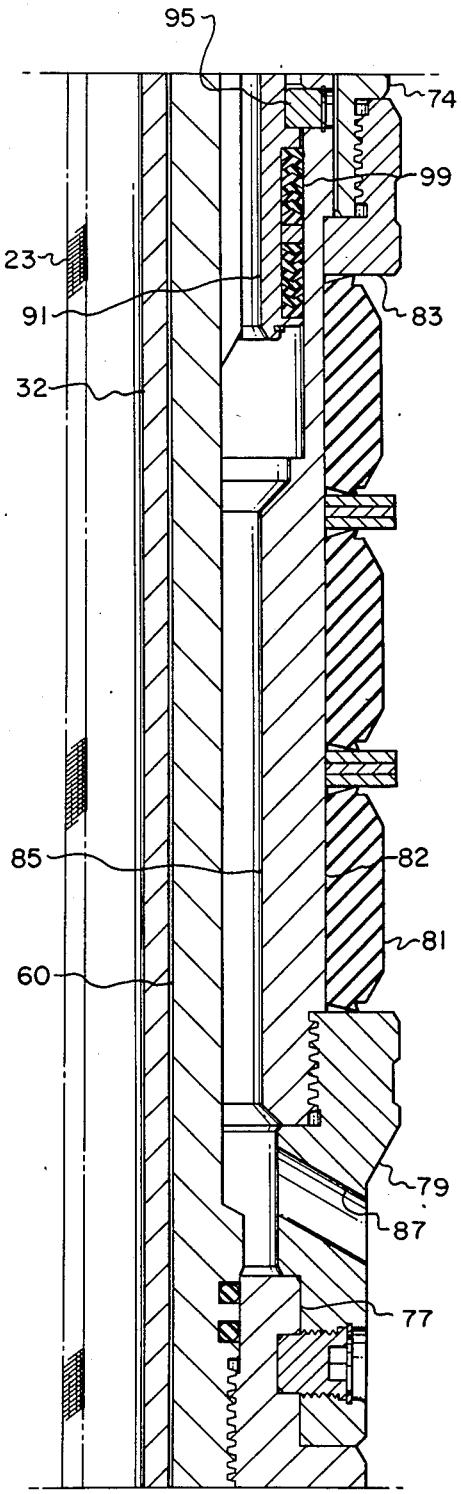
Figure 2K:
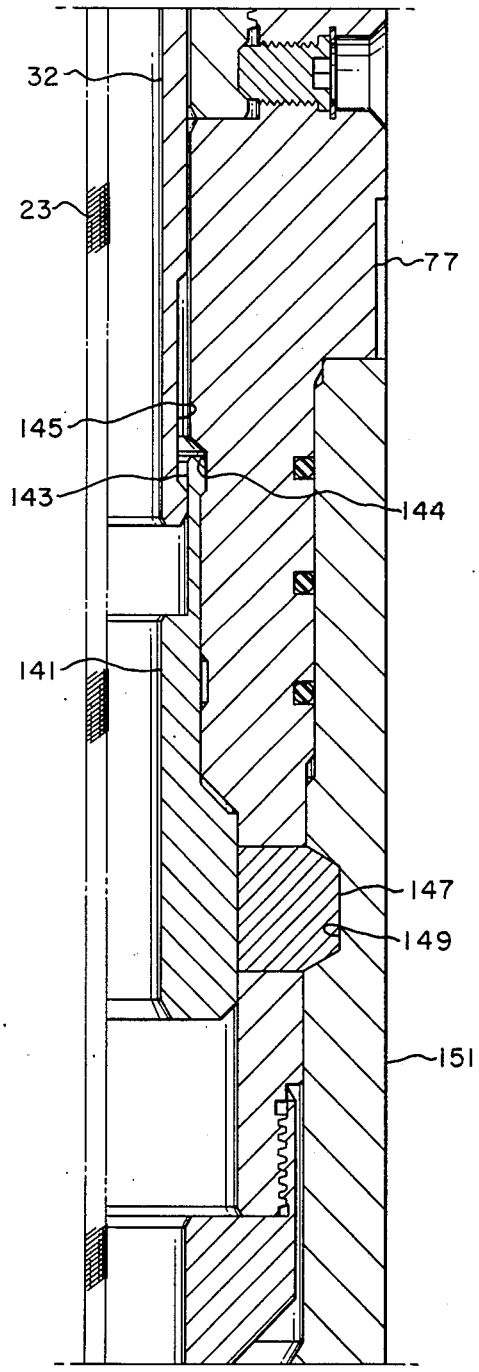
Figure 2L:
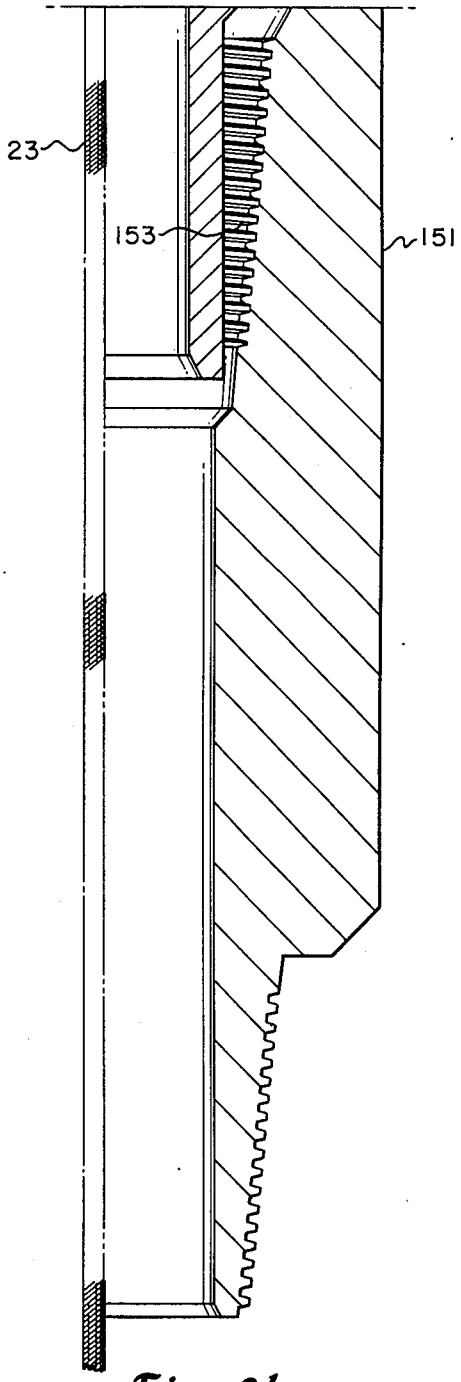

Referring to FIG. 2*j*, note that the inner barrel 60 does not move downwardly due to hydraulic pressure being applied to the piston 61 (FIG. 2*g*). The inner barrel 60 is connected to the drill string 17 for movement therewith through its connection with the outer housing 31 as shown in FIG. 2*f*. Picking up on the drill string 17 while the dogs 69 are engaging the casing 11 as shown in FIG. 4*c*, causes the inner barrel 60 to move upward relative to the cone body 74.

Figure 5A:
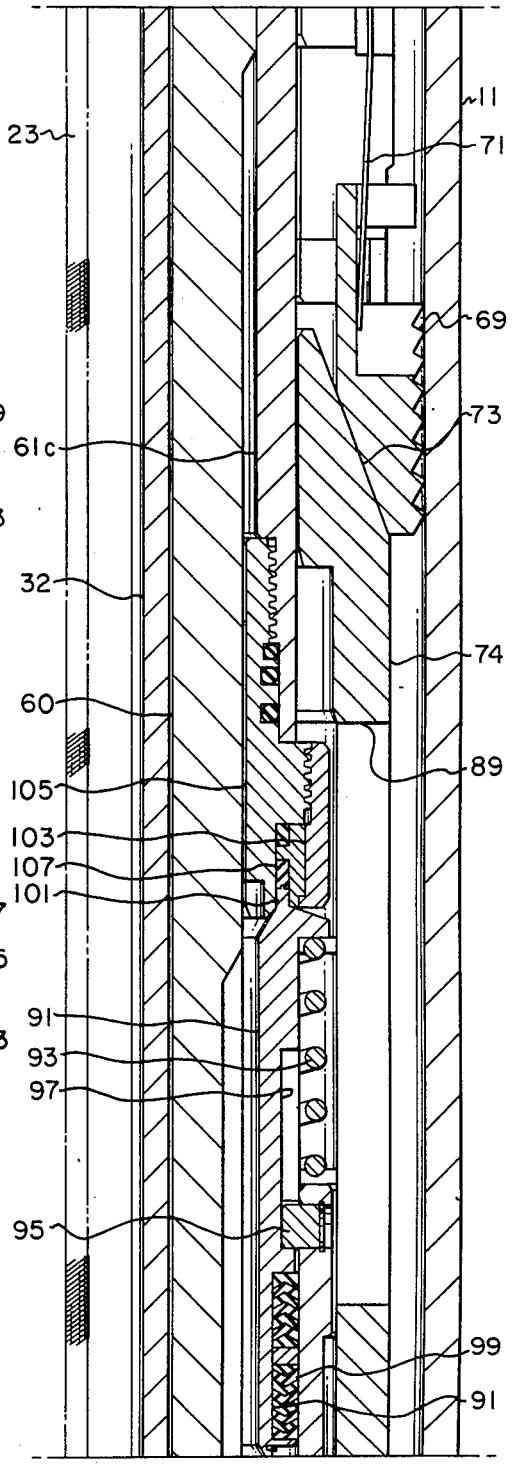
FIGS. 5*a* and 5*b* are sectional views showing portions of the assembly of FIG. 2, with the blowout preventer in the actuated position.
Figure 5B:
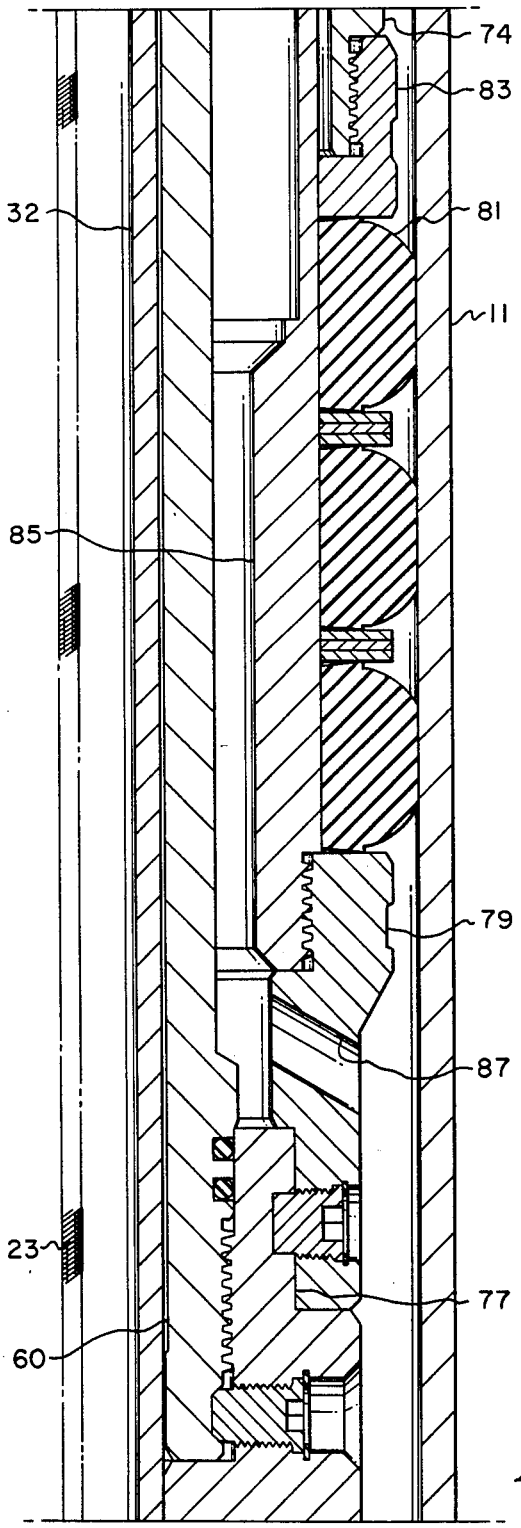

A linkage member 77, shown in FIG. 2*j*, links the inner barrel 60 to a lower compression member 79. The lower compression member 79 is mounted below a plurality of annular elastomeric packer elements 81. The packer elements 81 are mounted around a retainer 82. An upper compression member 83 is rigidly mounted to the cone body 74 and is located directly above the packer elements 81. Upward movement of the inner barrel 60 causes the lower compression member 79 to move upwardly because of the linkage member 77, compressing the elements 81 against the upper compression member 83, which is stationary. This causes the packer elements 81 to expand outwardly and seal against the casing as shown in FIG. 5*b*. This movement also more tightly wedges the dogs 69 against the casing 11.

A bypass passage 85 is located in the inside of the retainer 82, shown in FIG. 2*j*. The bypass passage 85 is connected on its lower end to a lower bypass port 87, which extends to the well fluid in the annulus of the drill string 17 below the packer elements 81. A large upper bypass port 89, shown in FIG. 2*i*, communicates the annulus surrounding the drill string 17 above the packer elements 81. The bypass passage 85 connects the lower bypass port 87 with the upper bypass port 89. The purpose of the bypass passage 85 is to allow fluid to bypass the packer elements 81 when they are retracted as shown in FIG. 2*j*. This allows fluid to flow easily past the large diameter packer elements 81 when the drill pipe 17 is being raised or lowered.

Once the packer elements 81 are fully sealed against the casing 11, means is employed to close the bypass passage 85. This includes a bypass valve 91 shown in FIG. 2*j*. The valve 91 is carried in the upper end of the retainer 82, which moves upwardly with the inner barrel 60 as the drill string 17 is picked upward. Bypass valve 91 is mounted to the elastomer retainer 82 by a coil spring 93 for cushioning. A pin 95 (FIG. 2*j*) located in a slot 97 in bypass valve 91 guides the vertical movement of the valve 91 relative to the retainer 82. Seals 99 seal against the interior of retainer 82 to prevent leakage from bypass passage 85 when the bypass valve 91 is closed as shown in FIG. 5*a*. Bypass valve 91 has a sealing nose 101 on its upper end.

A seat member 105 (FIG. 2*i*) is mounted to the lower end of piston extension 61*c* for movement therewith. Seat member 105 has an annular cavity 103 for sealingly receiving the nose 101 of bypass valve 91. An annular seal 107 is located in cavity 103 for sealing against the nose 101.

Figure 3B:
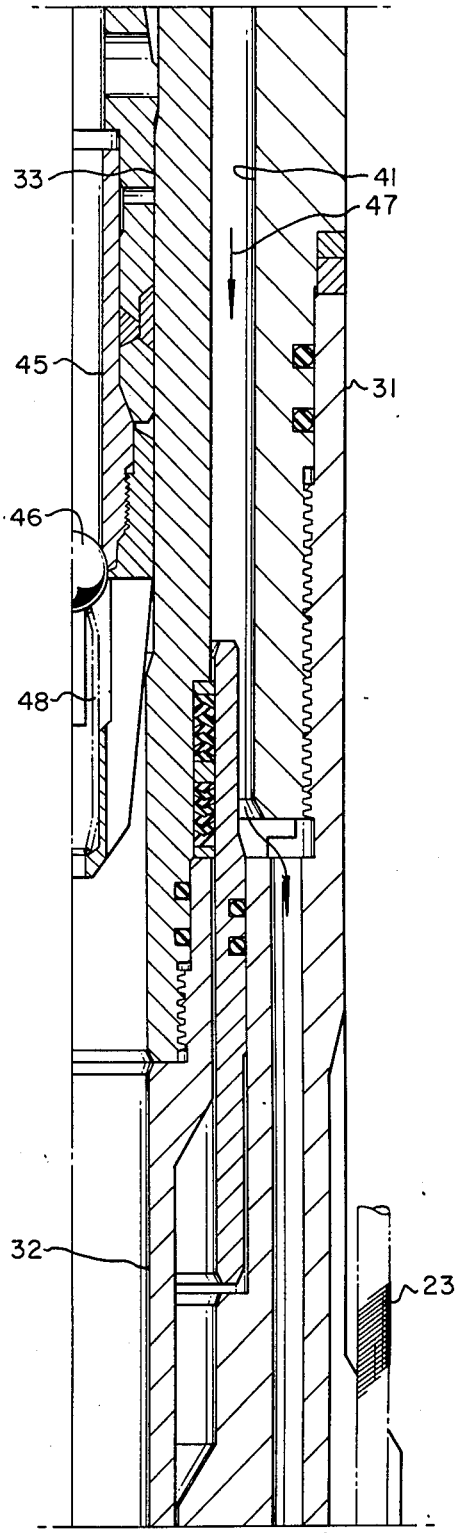

In the operation of the blowout preventer, should fluid begin flowing up the annulus in casing 11, check valve 45 (FIG. 3*a*) is dropped or pumped into the interior of the drill pipe 17 at the surface. The check valve 45 will land on the seat 43 and shift the piston valve 35 to the open position shown in FIG. 3*a*. Drilling fluid pumped from the surface then flows through the port 39 and piston fluid passage 41, as shown by the arrows 47 in FIG. 3*b*.

The drilling fluid pressure pushes the piston 61 downwardly, shown in FIG. 4*a*, causing the collet 63 to release from the groove 65 shown in FIG. 4*b*. The downward movement of the piston lower extension 61*c* pushes the dogs 69 to the outer engaged position as shown in FIG. 4*c*.

Simultaneously, the drilling fluid pressure is applied to the packoff piston 53 (FIG. 2*f*) to further seal the packoff seals 55 around the cable 23. The drilling fluid is free to flow through the check valve 45 down into the drill pipe 17 below the side entry sub 21.

Once the dogs 69 begin gripping the casing as shown in FIGS. 4*c*, the drill string 17 is picked up by the drll rig 15. The upward movement is transmitted through the outer housing 31 (FIGS. 2*a*–2*f*) to the inner barrel 60. The upward movement of the inner barrel 60 is transferred through the linkage member 77 (FIG. 2*j*) to the lower compression member 79. This upward movement deforms the packer elements 81 into sealing engagement with the casing 11 as shown in FIG. 5*b*.

Also, as fluid pressure is applied to the drill string 17 at the surface, moving the piston 61 downward, the seat member 105 will move downward to the position shown in FIG. 4*c*. As the drill string is picked upward with the dogs 69 extended, the bypass valve 91 will move upward with the inner barrel 60, causing the nose 101 to sealing engage cavity 103, closing the upper bypass port 89 as shown in FIG. 5*a*. The packer elements 81 will then sealingly contain any pressure in the casing 11 below the elements 81.

Once the packer elements 81 are selaed as shown in FIG. 5*b*, fluid cannot flow up the casing 11 annulus around the drill pipe 17. Using conventional techniques, the well could be killed, by pumping heavy drilling mud down the drill string 17, which flows through the check valve 45 and out ports provided in the drill string near the logging instruments 19.

Once the pressure is under control, the packer elements 81 can be released from sealing engagement merely by lowering the drill string 17. This causes the inner barrel 60 and the lower compression member 79 to move downwardly relative to the upper compression member 83 to the position shown in FIG. 2*j*.

The slips or dogs 69 are released from the engaged position shown in FIG. 4*c* once the pressure in the bore 32 is substantially the same as the pressure in the annulus surrounding the outer barrel 62 and after the packer elements 81 are retracted. The differential area of piston 61 is exposed to the interior pressure through the upper interior port 39 (FIG. 3*a*). The lower end of piston 61 is exposed to well annulus pressure above the packer elements 81 through the lower exterior port (FIG. 4*b*). Because of the greater pressure area of the lower piston portion 61*b* then of the upper piston portion 61*a*, the net force is upward. As the piston 61 moves upward, it will draw along with it the slip retainer 67 and the dogs 69, pulling them upwardly relative to the cone surface 73 to the position shown in FIG. 2*i*. The drill string 17 may then be retrieved. If the drill string 17 is stuck in open hole 13, the release mechanism can be actuated as explained below to remove the cable 23 and side entry sub 21.

The piston valve 35, piston 61, and check valve 45 serve along with associated components as actuating means for actuating the packer elements 81 into sealing engagement with the casing 11. More particularly, the check valve 45 serves as directing means for directing a portion of the drilling fluid pumped from the surface to the piston to start the actuation. The piston valve 35 serves as isolation means for isolating the piston 61 from drilling fluid pressure during normal logging.

RELEASE MECHANISM

Should the drill pipe 17 become stuck, it may be necessary to release the upper portion of the drill pipe and the side entry sub 21 (FIG. 1) from the drill pipe that extends down into open hole 13. Releasing the side entry sub 21 from the lower portion of the drill pipe 17 enables the cable 23 to be pulled from the drill pipe. Once the cable 23 is removed, the upper portion of the drill string 17 can be lowered back into engagement with the lower portion for using hydraulic jars and other devices to pull the drill pipe 17 from the well.

The releasing mechanism includes a seat 113, shown in FIG. *2a*, that is located in the bore 33 of mandrel 32 above the seat 43 for the check valve 45 (FIG. *3a*). Seat 113 is adapted to receive a solid plug (not shown) that is dropped from the surface. The plug will seal the bore 33, and will also shift an upper circulation sleeve 115 downwardly. The movement of the sleeve 115 to the lower position exposes an upper circulation port 117.

Drilling fluid pressure applied from the surface flows through the port 117 and a circulation passage 119. Referring to FIG. *2b*, the pressure shears a shear pin 121, which enables a retaining sleeve 123 to move downwardly due to the hydraulic pressure. As sleeve 123 moves downwardly, it allows dogs 125 to retract. This allows the entire mandrel 32 to move downwardly.

An over pressure port 127 located on the lower end of the sleeve 123 serves to prevent hydraulic fluid pressure during normal operation from shearing the pin 121. During normal operations, the drilling fluid pressure in the bore 33 of mandrel 32 will be the same at port 127 as at port 117 (FIG. *2a*), because no plug 111 will be present in the seat 113. The retaining sleeve 123 has a larger pressure area on its lower end than on its upper end. The same pressure applied to both ends results in a net upward force to prevent the shearing of pin 121 unless the plug 111 is present.

Referring still to FIG. *2b*, the downward movement of mandrel 32 shears shear pin 129 which is located in a lower circulation sleeve 131. The lower circulation sleeve 131 closes a lower circulation port 133 which leads back to the bore 33 of the mandrel 32. The lower circulation sleeve 131 has slots 135 on its lower end. As the mandrel 32 moves downwardly, the slotted lower end 135 will eventually contact a cylinder 137 stationarily mounted in the outer housing 31. This will stop the movement of the lower circulation sleeve 131 (FIG. *2b*), but not the mandrel 32, eventually causing alignment of the lower circulation port 133 with the slots 135. This allows drilling fluid pumped down the drill pipe 17 to flow around the plug 111 through the circulation passage 119 (FIG. *2a*), and out the port 133 (FIG. *2b*) back into the bore 33.

The mandrel 32 extends almost to the bottom of the side entry sub 21 assembly as can be seen in FIGS. *2a–2k*. As shown in FIG. *2f*, the mandrel 32 has a side aperture 139 to allow the passage of the cable 23. Referring to FIG. *2k*, the downward movement of the mandrel 32 will contact an upper shoulder on a latch sleeve 141. The latch sleeve 141 has collet fingers 143 that release from a groove 144 formed on a lower part of the linkage member 77. A recess 145 on the exterior of the lower end of the mandrel 32 allows the collet fingers 143 to expand inwardly as the mandrel 32 is moved downwardly. The mandrel 32 will push the latch sleeve 141 down, releasing dogs 147.

The dogs 147 are located in grooves 149 in a lower sub 151 which is screwed to the drill pipe 17 below the side entry sub assembly 21. The dogs 147 retract inwardly, enabling the entire side entry sub 21 above the sub 151 to be pulled upwardly. Threads 153 are located in the upper end of the sub 151 for use in retrieving the lower section of drill pipe.

In the releasing operation, which occurs when the drill pipe is stuck, the plug 111 is dropped into the drill pipe 17, and pressure is applied. If check valve 45 (FIG. *3a*) has been previously dropped to control a kick, there is no need to remove it, although in the preferred embodiment, the check valve 45 can be retrieved by a wireline.

Plug 111 will seal the bore 33 and move the sleeve 115 (FIG. *2a*) downwardly. The fluid pressure will pass through the port 117 to act on the sleeve 123 (FIG. *2b*), moving it downwardly to retract the dogs 125. The fluid pressure pushes the mandrel 32 downwardly. The lower end of the mandrel 32 will push the latch sleeve 141 downwardly, releasing the dogs 147. The drill string is picked up, leaving only the sub 151.

Once the linkage member 77 (FIG. *2c*) has moved out of the lower sub 151, the drilling fluid will flow from passage 119 (FIG. *2a*) through the port 133 (FIG. *2b*), since the sleeve 131 will be moved to the upper position. The drilling fluid will flow out the lower end of the assembly to circulate back up the annulus.

The invention has significant advantages. The blowout preventer enables the casing annulus below the side entry sub to be sealed to prevent a blowout. The packer is set quickly and easily. The packer can be released without destroying components.

While the invention has been shown in only one of its forms, it should be apparent to those skilled in the art that it is not so limited, but is susceptible to various changes without departing from the scope of the invention.

I claim:

1. In a well logging system in which conductor cable extends outside of a string of drill pipe into a sidewall passage of a side entry sub and through the drill pipe to a logging instrument located at the lower end of the drill pipe, the improvement comprising means for sealing the sub to casing in case of a kick, comprising in combination:

packer means mounted to the sub below the sidewall passage, having an elastomeric element, for expansion of the element into sealing engagement with the casing;

actuating means located in the sub and operable from the surface for actuating the packer means into sealing engagement with the casing, and for selectively releasing the packer means from sealing engagement with the casing once the kick has been controlled.

2. In a well logging system in which conductor cable extends outside of a string of drill pipe into a sidewall passage of a side entry sub and through the drill pipe to a logging instrument located at the lower end of the drill pipe, the improvement comprising means for sealing the sub to casing in case of a kick, comprising in combination:

packer means mounted to the sub below the sidewall passage, having an elastomeric element, for expansion of the element into a sealing engagement with the casing;

actuating means located in the sub and operable from the surface for actuating the packer means into sealing engagement with the casing, and for selectively relasing the packer means from sealing engagement with the casing once the kick has been controlled;

the packer means including slip means having a plurality of dogs with gripping outer surfaces, for expansion into the casing to hold the elastomeric element against axial forces, the slip means being set by the actuating means;

the actuating means including isolation means for isolating the packer means during normal operation from any actuating forces due to fluid pressure in the drill pipe;

bypass passage means in the sub extending from a lower exterior port below the elastomeric element to an upper exterior port above the elastomeric element, for communicating fluid in the casing below the element with fluid in the casing above the element; and bypass valve means in the bypass passage means for closing the bypass passage means when the elastomeric element is fully actuated into sealing engagement with the casing.

3. In a well logging system in which conductor cable extends outside of a string of drill pipe into a sidewall passage of a side entry sub adapted to be positioned downhole in casing, the cable extending through the drill pipe to a logging instrument located at the lower end of the drill pipe, the improvement comprising means for sealing the sub to the casing in case of a kick, comprising in combination:

slip means located below the sidewall passage having a plurality of dogs with gripping outer surfaces, for moving between a retracted position to an expanded position into the casing to hold the sub against axial forces;

piston means in the sub, moved by hydraulic pressure applied from the surface, for moving the dogs to the expanded position free of rotation of the drill string;

directing means adapted to be lowered into the drill pipe from the surface and into the sub for directing actuating forces from the hydraulic pressure applied from the surface to the piston means to move the piston means and the dogs to the expanded position;

an elastomeric element located in the sub below the side opening, expansible from a retracted position to an expanded position into sealing contact with the casing;

linkage means for moving the elastomeric element to the expanded position free of rotation of the drill pipe by lifting the drill pipe after the dogs are in the expanded position, and for returning the elastomeric element back to the retracted position by lowering the drill pipe; and release means for selectively returning the slip means back to the retracted position.

4. The system according to claim 3, further comprising:

piston valve means located in the bore of the sub for blocking from the piston means fluid pressure in the drill pipe when in a closed position, and when in an open position, for communicating fluid pressure in the drill pipe to the piston means, the piston valve means being moved to the open position by engagement of the directing means as it moves downwardly into the sub.

5. The piston according to claim 3 wherein the directing means comprises a tubular element having a passage extending therethrough which allows fluid to be pumped downwardly through the tubular element.

6. The system according to claim 3 further comprising a packoff passage extending from the piston means to the sidewall passage; and expansible packoff means surrounding the cable at the sidewall passage and in communication with the packoff passage for sealing the cable in the sidewall passage with hydraulic pressure supplied to the piston means.

7. The system according to claim 3 wherein the release means comprises a lower portion on the piston means which has a greater pressure area than an upper portion of the piston means, and exterior port means exposing the lower portion of the piston means to fluid pressure in the casing above the elastomeric element, the piston means being connected to the slip means for moving the slip means back to the retracted position when the pressure in the casing above the eleastomeric element is at least equal to the pressure in the bore of the drill pipe.

8. In a well logging system in which conductor cable extends outside of a string of drill pipe into a sidewall passage of a side entry sub adapted to be positioned downhole in casing, the cable extending through the drill pipe to a logging instrument located at the lower end of the drill pipe, the improvement comprising means for sealing the sub to the casing in case of a kick, comprising in combination:

slip means located in the sub below the sidewall passage, having a plurality of dogs with gripping outer surfaces for movement between a retracted position and an expanded position into the casing to hold the sub against axial forces;

an elastomeric element located in the sub below the sidewall passage, expansible from a retracted position to an expanded position in sealing contact with the casing;

a differential area piston means located in the sub and connected to the slip means, and movable between upper and lower positions, for retracting and expanding the slip means in response to fluid pressure applied to the drill pipe at the surface, the piston means including a piston having a greater pressure area on a lower side than on an upper side;

piston valve means located in the bore of the sub for blocking fluid pressure in the drill pipe from the piston means when in an upper position, and when in a lower position from communicating fluid pressure in the drill pipe to the piston means;

directing means for lowering into the drill pipe and into the sub from the surface should a kick occur, for moving the piston valve means to the lower position to enable fluid pressure from the surface to be applied to the piston means;

linkage means for moving the elastomeric element to the expanded position free of rotation of the drill pipe by lifting the drill pipe after the slip means is in the expanded position, and for retracting the elastomeric element back to the retracted position by lowering the drill pipe;

a release port communicating the lower side of the piston with fluid pressure in the casing, for moving the piston to the upper position and retracting the slip means when the elastomeric element is in the retracted postion and the pressure in the casing is at least equal to the pressure in the bore of the drill pipe acting on the upper side of the piston;

bypass passage means in the sub extending from a lower exterior port below the elastomeric element to an upper exterior port above the elastomeric element, for communicating fluid in the casing below the element with fluid in the casing above the element; and bypass valve means in the bypass passage means for closing the bypass passage means when the elastomeric element is fully actuated into sealing engagement with the casing.

9. In a well logging system in which conductor cable extends outside of a string of drill pipe into a sidewall passage of a side entry sub adapted to be positioned downhole in casing, the cable extending through the drill pipe to a logging instrument located at the lower end of the drill pipe, the improvement comprising in combination:

packer means mounted to the side entry sub below the sidewall passage, having an elastomeric element, for expansion of the element into sealing engagement with the casing;

actuating means located in the side entry sub operable from the surface for actuating the packer means into sealing engagement with the casing, and for selectively releasing the packer means from sealing engagement with the casing once the kick is controlled;

a release sub adapted to be connected to the drill pipe below the side entry sub;

a mandrel adapted to be carried in the side entry sub and to extend into the release sub, the mandrel being movable relative to the side entry sub under sufficient fluid pressure from an upper position to a lower position;

latch means for latching the side entry sub to the release sub, and when engaged by the mandrel in its lower position, for releasing the side entry sub from the release sub to enable the side entry sub to be pulled upward; and means adapted to be lowered into the drill pipe from the surface for directing force from fluid pressure applied to the interior of the drill pipe at the surface to the mandrel to move the mandrel to the lower position.

10. In a method of logging a well wherein a logging instrument is mounted to the bottom of the drill pipe, a side entry sub is secured in the drill pipe and logging cable is lowered down through the drill pipe through a sidewall passage in the sub to the instrument, and the side entry sub is lowered into the well and casing, with the cable extending alongside the drill pipe to the surface, a method of sealing the sub in the casing should a kick occur, comprising in combination:

mounting a packer in the sub below the sidewall passage of a type that will seal against the casing when actuated;

if a kick occurs, actuating the packer to seal against the casing; then once the kick is under control, releasing the packer to enable the drill pipe to be pulled from the well.

11. The method according to claim 10 wherein the step of mounting the packer in the sub includes positioning the packer so that it is isolated from any actuating force due to hydraulic pressure applied from the surface, and the step of actuating the packer further comprises dropping a directing means into the drill pipe and into the sub for directing force from hydraulic pressure applied from the surface to the packer to actuate the packer.

12. The method according to claim 10 wherein the step of actuating the packer further includes the step of picking up the drill pipe, and the step of releasing the packer comprises lowering the drill pipe with the hydraulic pressure at the surface removed.

* * * * *